United States Patent [19]

Pertuit

[11] Patent Number: 5,042,593

[45] Date of Patent: Aug. 27, 1991

[54] HYDRAULICALLY DAMPED DETONATOR FOR USE IN PERFORATING OIL WELL TUBING

[75] Inventor: Jimmy Pertuit, Raceland, La.

[73] Assignee: Lloyd J. Songe, Jr., Bourg, La. ; a part interest

[21] Appl. No.: 608,332

[22] Filed: Nov. 2, 1990

[51] Int. Cl.[5] ..... E21B 43/1185

[52] U.S. Cl. ..... 175/4.52; 175/4.54; 175/4.56

[58] Field of Search ..... 175/4.52, 4.54, 4.56; 166/55.1

[56] References Cited

U.S. PATENT DOCUMENTS

| | | | |
|---|---|---|---|
| 2,638,981 | 5/1953 | Bannon et al. | 175/4.54 X |
| 2,869,825 | 1/1959 | Crawford | 175/4.56 X |
| 3,180,261 | 4/1965 | Moore | 175/4.52 X |
| 3,189,094 | 6/1965 | Hyde | 175/4.52 |
| 3,366,179 | 1/1968 | Kinley et al. | 175/4.56 X |
| 3,375,785 | 4/1968 | Moore | 175/4.52 X |
| 3,800,705 | 4/1974 | Tamplen | 175/4.54 X |
| 4,629,009 | 12/1986 | Whiting et al. | 175/4.56 |
| 4,770,246 | 9/1988 | Ward | 175/4.54 X |
| 4,886,127 | 12/1989 | Rieles et al. | 175/4.54 |

*Primary Examiner*—Hoang C. Dang

*Attorney, Agent, or Firm*—Pravel, Gambrell, Hewitt, Kimball & Krieger

[57] ABSTRACT

A hydraulically dampened detonator for firing an oil well perforating gun can be lowered into the well on a slick line (i.e., a solid cable line) and set rigidly against the well tubing inner wall. The tool uses a hydraulically dampened piston to power a firing pin that detonates a cartridge (e.g. a .22 caliber hornet or the like) to fire an explosive charge. A jar or other commerically available weighing or loading tool can be lowered with the slick line to load the piston and firing pin to detonate the cartridge. Hydraulic dampening prevents inadvertent firing and controls a preliminary lowering of the piston just prior to firing.

25 Claims, 2 Drawing Sheets

HYDRAULICALLY DAMPED DETONATOR FOR USE IN PERFORATING OIL WELL TUBING

BACKGROUND OF THE INVENTION:

1. Field of the Invention

The present invention relates to oil well downhole tools and more particularly to an improved firing mechanism for firing a perforating gun wherein an improved oil dampened firing mechanism allows the tool to be lowered on a slick line having no through bore, with a jar mechanism carried by the slick line used to fire the mechanism.

2. General Background

When drilling oil wells, typically a vertical hole is drilled in the ground and relatively large diameter pipe (called casing) is inserted in the hole to prevent the walls of the hole from collapsing into the hole. When it is desired to produce the well, it is necessary to make holes in the casing to allow the oil to enter the bore of the casing and travel upward to the surface. A common way of perforating the casing is to lower a perforating gun into the hole until it reaches a point where the perforations are desired. The perforating gun has a timer, and is set at the surface to go off a certain amount of time after pins are sheared which activates the timer. Unfortunately, if the perforating gun gets stuck on the way down to the production center, there is no way to turn off the timer. The perforating gun may sometimes fire at the wrong location, producing unwanted and unnecessary perforations in the casing which could allow gas under pressure to enter the casing and cause a blow out of the well.

SUMMARY OF THE INVENTION:

The present invention provides an improved, dampened firing mechanism for an oil well perforating gun that can be run inside oil well tubing to be perforated. The firing mechanism comprises an elongated tool body having an upper end adapted for connection to a slick line and a firing chamber at the bottom of end portion of the tool body having a firing chamber for carrying an explosive charge and a breech for carrying a detonatable cartridge portion that can fire the explosive charge. A commercially available perforating gun attaches to a threaded end of the firing chamber.

The firing mechanism also has a firing pin slidably mounted in the tool body to travel between a first upper position, an intermediate position wherein the firing pin is positioned adjacent but not contacting the cartridge, and a third lower position wherein the cartridge is contacted by the firing pin.

The firing mechanism of the oil well perforating gun has a tubing stop (or a casing stop of similar construction) on the tool body for affixing the tool body with respect to the well tubing (or well casing) at a desired elevation in the well where the tubing is to be perforated. The mechanism of the present invention has a longitudinal extending cylindrical uniform bore at the upper end of the tool body which includes a piston slidably mounted in the longitudinal bore and the firing pin being connected to the piston for sliding movement therewith.

An oil reservoir in the tool body communicates with the longitudinal bore and the piston has an enlarged diameter portion that registers with the inside wall of the longitudinal bore. The reservoir and piston define a dampening mean for slowing the lowering motion of the firing pin from the first upper to the intermediate position so that inadvertent firing is prevented.

The present invention provides a longitudinal bore above the tubing stop. The piston of the present invention defines the upper end of the tool body and the top of the piston is threaded for attachment to a slick line.

Shear pins for holding the piston in the first upper position can be sheared after the tool is downhole. A flow channel communicates with the oil reservoir on opposite sides of the enlarged diameter portion of the piston, so that fluid in the reservoir can flow between portions of the oil reservoir above and below the enlarged diameter portion of the piston. A valve seat controls flow in the channel and a valving member is registerable upon the seat to valve flow at the seat. This valve seat includes biasing to hold the valve member against the valve seat when the piston is moving downwardly toward firing position. An orifice channel, smaller in cross section than the flow channel bleeds fluid flow around the closed valve seat between portions of the flow channel on opposite sides of the valve seat so that a very slow deliberate lowering of the piston is achieved The present invention utilizes a tubing stop assembly that includes a plurality of expandable portions that move laterally away from the longitudinal central axis of the tool body when affixing the tool body to a section of well tubing, and the expandable portions have teeth thereon for gripping the well tubing before firing the cartridge.

The firing pin attaches to the piston at its lower end portion and an annular shoulder is spaced radially outwardly of the thickness of the firing pin. The firing pin is of a cylindrical shape and the piston has a larger diameter than the firing pin. A coil spring is disposed about the firing pin and has one end facing the annular shoulder for contacting same. The tool body has a stop that supports the bottom end of the coil spring.

The present invention further provides a longitudinal bore that includes an upper reservoir portion containing oil, a lower portion, and a seal for preventing fluid flow from the reservoir to the lower portion of the longitudinal bore, and the piston extends through the reservoir at least partially into the lower portion. The upper end of the firing pin connects to the lower end of the piston at the lower portion of the longitudinal bore. The tool body has an upper hollow section that carries the longitudinal bore, and the tubing stop removably attaches to the bottom end of the hollow section. The firing pin extends through at least a portion of the hollow section and through the tubing stop means.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

Figure 1:
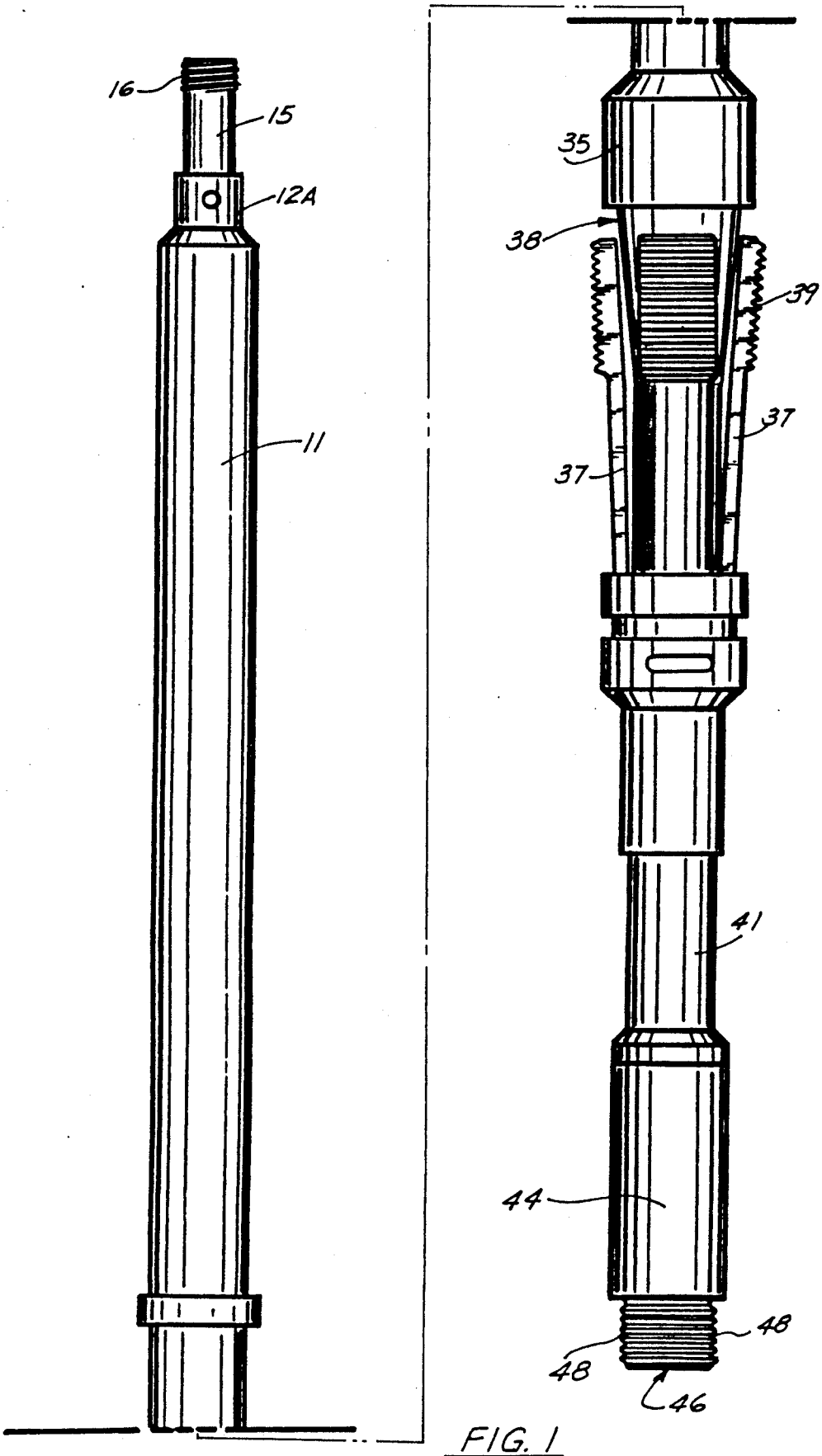
FIG. 1 is a side view, partially sectional of the preferred embodiment of the apparatus of the present invention.
Figure 2:
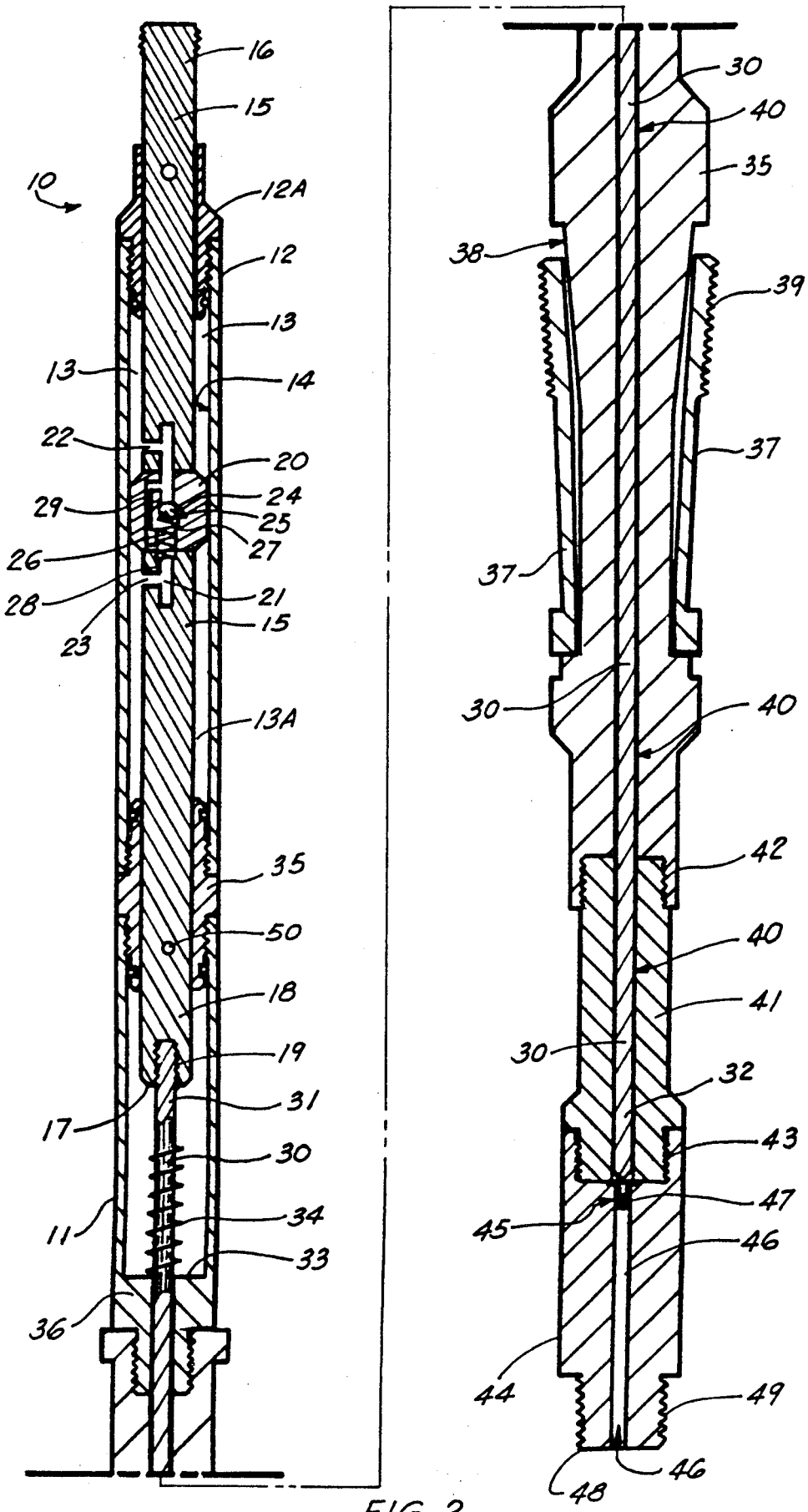
FIG. 2 is a sectional, fragmentary view of the preferred embodiment of the apparatus of the present invention.

DETAILED DESCRIPTION OF THE PREFERRED EMBODIMENT:

FIG. 1-2 show generally the preferred embodiment of the apparatus of the present invention, designated generally by the numeral 10. Detonator apparatus 10 includes a tool body 11 that has an upper hollow section 12 with a central, cylindrical longitudinal bore 13 and a bore inner wall 14 for slidably receiving piston 15. An oil reservoir 13A preferably filled with oil and some air fills the area between piston 15 and hollow section 12 and above tool section 35 which forms a lower seal to reservoir 13A. The upper end 12A of hollow section 12 defines an uppermost seal to reservoir 13A.

An enlarged diameter portion 20 of piston 15 registers against wall 14. Piston 15 has an upper threaded end 16 and a lower end 18 with an annular shoulder 17 surrounding the upper end 31 of firing pin 30. A threaded connection 19 connects firing pin 30 to piston 15.

A longitudinally extending flow channel 21 in piston 15 communicates with an upper transverse port 22 and lower transverse port 23. Valve seat 24 and valving member 25 control fluid flow in channel 21 so that piston 15 can rise rapidly with respect to hollow section 12 of tool body 11, but slows movement of piston 15 with respect to body Il during a lowering of piston 15 into bore 13 of tool body 11 hollow section 12.

Spring 26 biases valve 25 to seat 24. Annular shoulder 27 in channel 21 holds valve 25 adjacent seat 24 while shoulder 28 holds spring 26 in channel 21 and in its biasing position to hold valve member 25 against seat 24.

A bleed-by flow system in the form of small orifice channel 29 allows flow to bypass channel 21 when valve 25 is closed against seat 24, as when piston 15 is being urged downwardly toward lower end 48 of tool body 11. The channel 29 is very small so that oil in the reservoir 13A between piston 15 and hollow section 12 inner wall 14 flows slowly from one side of enlarged diameter section 20 of piston 15 to the other providing a dampening action to downward movement of piston 15 and firing pin 30. This dampening action discourages inadvertent firing of the cartridge 27.

Coil spring 34 abuts annular shoulders 17 and 33 so that the coil spring 34 stops downward movement of piston 15 and the attached firing pin 30 at a position where the lower end 32 of firing pin 30 is closely adjacent but spaced from (e.g., ¼-½ inches) the detonatable cartridge 47 (e.g., a .22 caliber Hornet). A jar or other hammering tool (commercially available) can then abruptly load or strike upper end of piston 15, thrusting piston 15 and firing pin 30 downwardly so that firing pin 30 lower end 32 hits cartridge 47 firing it to detonate the attached perforating gun (not shown) which is any commercially available perforating gun or jet cutter affixed to tool body 11 at 48.

A tool joint section 35 connects hollow section 12 and tool section 36 which is positioned above tubing stop 37. Tubing stop 37 can spread its tubing gripping members 39 outwardly along frustro-conical surface 38 to anchor the tool body 11 against the well tubing at a desired elevational position. This is done by simply abruptly pulling up on the threaded end 16 with a supporting slick line for example.

A longitudinal bore 40 accommodates firing pin 30. A lower tool section 41 connects between the commercially available tubing stop 37-39 and the firing chamber section 44 at threaded connections 42, 43 respectively. Firing chamber section 44 has a hollowed breech 45 for holding the cartridge 47 in position aligned with the sliding movement of firing pin 30. A primer cord chamber 46 contains primer cord that is used to fire the attached perforating gun (commercially available) when cartridge 47 detonates.

Lower end 48 of tool body is threaded at 49 for attaching a perforating gun thereto at the threaded connection 49. A shear pin 50 holds piston 15 in the uppermost position so that firing pin 30 is spaced in a farthest position from cartridge 47 upon entry to the well. The pin 50 is sheared by locking the tool 10 in the tubing or casing with tubing stop 37 and the hitting, jarring or loading the top threaded end portion 16 of the piston using a spang jar or hammering tool which are commercially available known oil field tools used in slick line operations to jar upwardly or downwardly. Spang jars are manufactured and sold by specialty machine of Houston, Tex. as an example. O-rings can be used between piston 15 and tool body 11 to prevent leakage of oil from bore 13. O-rings can also be used between the various tool 10 sections to prevent invasion of well fluids.

The following Table provides a summary for quick reference purposes of the part numbers used in the drawings and written specification and the part descriptions used in the written specification.

| PART NO. | |
|---|---|
| 10 | Detonator apparatus |
| 11 | Tool body |
| 12 | Hollow section of tool body |
| 12A | Upper seal |
| 13 | Longitudinal bore |
| 13A | Reservoir |
| 14 | Bore inner wall |
| 15 | Piston |
| 16 | Piston upper threaded end |
| 17 | Lower annular shoulder |
| 18 | Piston lower end |
| 19 | Internal threads |
| 20 | Enlarged diameter section of piston |
| 21 | Flow channel |
| 22 | Port, upper |
| 23 | Port, lower |
| 24 | Valve seat |
| 25 | Valving member |
| 26 | Spring |
| 27 | Shoulder |
| 28 | Shoulder |
| 29 | Small orifice channel (bleed by path) |
| 30 | Firing pin |
| 31 | Firing pin |
| 32 | Firing pin lower end |
| 33 | Annular shoulder |
| 34 | Coil spring |
| 35 | Tool section |
| 36 | Tool section |
| 37 | Tubing stop |
| 38 | Frustro-conical surface |
| 39 | Tube gripping members |
| 40 | Longitudinal bore for firing pin |
| 41 | Tool section (lower) |
| 42 | Threaded connection |
| 43 | Threaded connection |
| 44 | Firing chamber |
| 45 | Breech |
| 46 | Primer cord chamber |
| 47 | Detonatable cartridge (.22 hornet) |
| 48 | Lower end of tool body |
| 49 | Threaded connection |
| 50 | Shear pin |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A firing mechanism for an oil well perforating gun that can be run inside oil well tubing or casing to be perforated, comprising:

a) an elongated tool body having an upper end adapted for connection to a slick line;

b) a firing chamber at the bottom end of the tool body having means for carrying an explosive charge, and a breech for carrying a detonatable cartridge portion that can fire the explosive charge;

c) a firing pin slidably mounted in the tool body to travel between a first upper position, an intermediate position wherein the firing pin is positioned adjacent but not contacting the cartridge, and a third lower position wherein the cartridge is contacted by the firing pin;

d) tubing stop means on the tool body for affixing the tool body with respect to the well tubing or casing at a desired elevation in the well where the tubing or casing is to be perforated;

e) a longitudinally extending cylindrical uniform bore at the upper end of the tool body;

f) the tool body including a piston slidably mounted in the longitudinal bore and the firing pin being connected to the piston for sliding movement therewith;

g) an oil reservoir in the tool body, communicating with the longitudinal bore;

h) the piston having an enlarged diameter portion that registers with the inside wall of the longitudinal bore; and i) dampening means for slowing a lowering motion of the firing pin from the first upper to the intermediate position.

2. The apparatus of claim 1 wherein the longitudinal bore is above the tubing stop means.

3. The apparatus of claim 1 wherein the piston defines the upper end of the tool body.

4. The apparatus of claim 3 wherein the top of the piston is threaded for attachment to a slick line.

5. The apparatus of claim I further comprising shear pin means for holding the firing pin in the first upper position.

6. The apparatus of claim 1 further comprising a flow channel communicating with oil on opposite sides of the enlarged diameter portion of the piston so that fluid in the reservoir can flow between portions of the oil bath above and below the enlarged diameter portion of the piston.

7. The apparatus of claim 6 further comprising valve means for controlling flow in the channel.

8. The apparatus of claim 7 further comprising a valve seat in the flow channel and a valving member registerable upon the seat to control flow at the seat.

9. The apparatus of claim 8 further comprising biasing means to hold the valve member against the valve seat.

10. The apparatus of claim 9 further comprising an orifice, smaller in cross section than the flow channel for bleeding fluid flow around the valve seat between portions of the flow channel on opposite sides of the valve seat.

11. The apparatus of claim I wherein the tubing stop means includes a plurality of expandable portions that move laterally away from the longitudinal central axis of the tool body when affixing the tool body to a section of well tubing or casing.

12. The apparatus of claim wherein the expandable portions have teeth thereon for gripping the well tubing or casing.

13. The apparatus of claim I wherein the piston has a lower end portion with an annular shoulder and the firing pin attaches to the piston at its lower end portion, the shoulder being spaced radially outwardly of the thickness of the firing pin.

14. The apparatus of claim 13 wherein the firing pin is of a cylindrical shape and the piston has a larger diameter than the firing pin.

15. The apparatus of claim 14 further comprising coil spring means disposed about the firing pin and having one end facing the annular shoulder for contacting same.

16. The apparatus of claim 15 wherein the tool body ha a stop that supports the bottom end of the coil spring.

17. The apparatus of claim 1 wherein the longitudinal bore includes an upper wet portion containing the reservoir, a lower portion, and seal means for preventing fluid flow from the reservoir to the lower portion of the longitudinal bore, and the piston extends through the reservoir and at least partially into the lower portion.

18. The apparatus of claim 17 wherein the upper end of the firing pin connects to the lower end of the piston at the lower portion of the longitudinal bore

19. The apparatus of claim 18 wherein the tool body has an upper hollow section that carries the longitudinal bore, and the tubing stop means removably attaches to the bottom end of the hollow section, and the firing pin extends through at least a portion of the hollow section, and through the tubing stop means.

20. A hydraulically dampened firing mechanism for use in oil well perforating comprising:

a) tool body means including first hollowed section, for containing an oil reservoir therein;

b) firing pin means for detonating a perforating explosive charge;

c) the tool body means including piston means connected to said firing pin means extending through the hollowed section and reservoir for powering the firing pin means;

d) dampening means for controlling the speed of movement of the piston means relative to the hollowed section;

e) stop means for affixing the position of the hollowed section in the well so that the piston means can be loaded; and f) connection means at the top of the piston means and above the hollowed section for supporting the tool body means so that it can be lowered into the well upon a work line.

21. The apparatus of claim 20 wherein the connection means comprises a threaded portion of the piston means.

22. The apparatus of claim 20 wherein the piston means and firing pin means are connected for sliding movement together so that when the piston means is loaded, the firing pin is loaded, forcing both downwardly.

23. The apparatus of claim 20 wherein the tool body means includes the piston means, the hollowed section, the stop means, and a firing chamber and the hollowed section, stop means and firing chamber are connected together so that the piston means slide relative to the hollowed section, stop means and firing chamber.

24. The apparatus of claim 20 wherein the hollowed section includes wet and dry portions, and the dampening means comprises in part the oil reservoir that is contained in the wet portion of the hollowed section.

25. The apparatus of claim 24 wherein the dampening means comprises the oil reservoir, an enlarged diameter portion of the piston positioned inside the reservoir, and a flow channel within the piston that meters flow between portions of the oil reservoir on opposite sides of the enlarged diameter section of the piston means.

* * * * *